US012672666B2

(12) United States Patent
Blanc et al.

(10) Patent No.: US 12,672,666 B2
(45) Date of Patent: Jul. 7, 2026

(54) METHOD FOR TREATING TOBACCO MATERIAL AND TREATED TOBACCO MATERIAL

(71) Applicant: PHILIP MORRIS PRODUCTS S.A., Neuchatel (CH)

(72) Inventors: Michel Philippe Blanc, Corcelles (CH); Lucien Bovet, La Chaux-de-Fonds (CH)

(73) Assignee: Philip Morris Products S.A., Neuchatel (CH)

( * ) Notice: Subject to any disclaimer, the term of this patent is extended or adjusted under 35 U.S.C. 154(b) by 727 days.

(21) Appl. No.: 17/923,835

(22) PCT Filed: May 7, 2021

(86) PCT No.: PCT/EP2021/062194

§ 371 (c)(1),
(2) Date: Nov. 7, 2022

(87) PCT Pub. No.: WO2021/224474

PCT Pub. Date: Nov. 11, 2021

(65) Prior Publication Data

US 2023/0172258 A1 Jun. 8, 2023

(30) Foreign Application Priority Data

May 7, 2020 (EP) ..... 20173550

(51) Int. Cl.
*A24B 15/20* (2006.01)
*A24B 3/04* (2006.01)
(Continued)

(52) U.S. Cl.
CPC ..... *A24B 15/20* (2013.01); *A24B 3/04* (2013.01); *A24B 3/12* (2013.01); *A24B 9/00* (2013.01); *A24F 40/20* (2020.01)

(58) Field of Classification Search
CPC ..... A24B 15/20; A24B 1/00; A24B 15/10; A24B 15/18; A24B 3/12; A24B 15/183
See application file for complete search history.

(56) References Cited

U.S. PATENT DOCUMENTS 182,597 A * 9/1876 Philips ..... A24B 3/04 131/306
3,070,098 A * 12/1962 Tempel ..... A24B 15/20 131/309

(Continued)

FOREIGN PATENT DOCUMENTS

| | | |
|---|---|---|
| CN | 202262403 | 6/2012 |
| CN | 108541999 | 9/2018 |
| GB | 2542623 | 3/2017 |

OTHER PUBLICATIONS

PCT International Search Report and Written Opinion for PCT/EP2021/062914 dated Jul. 13, 2021 (11 pages).

(Continued)

*Primary Examiner* — Michael H. Wilson
*Assistant Examiner* — Stephanie Lynn Moore
(74) *Attorney, Agent, or Firm* — Mueting Raasch Group

(57) ABSTRACT

The invention relates to a method for treating tobacco material, the method comprising: o fermenting the tobacco material to obtain treated tobacco material, including: #incubating the tobacco material under anaerobic conditions; #applying a pressure to the tobacco material comprised between 1000 kilograms per square meter and 4000 kilograms per square meter; #keeping the moisture content of the tobacco material comprised between 25 percent in (Continued)

weight and 40 percent in weight of the total weight of the tobacco material; o wherein the fermenting lasts at least one month.

9 Claims, 3 Drawing Sheets

(51) Int. Cl.

| | |
|---|---|
| ***A24B 3/12*** | (2006.01) |
| ***A24B 9/00*** | (2006.01) |
| ***A24F 40/20*** | (2020.01) |

(56) References Cited

U.S. PATENT DOCUMENTS

| | | | | |
|---|---|---|---|---|
| 4,528,993 | A | 7/1985 | Sensabaugh, Jr. | |
| 5,372,149 | A | 12/1994 | Roth | |
| 2010/0300463 | A1* | 12/2010 | Chen ..... | A24B 15/302 131/274 |
| 2012/0060854 | A1 | 3/2012 | Chen | |

OTHER PUBLICATIONS

International Preliminary Report on Patentability for PCT/EP2021/062194 dated Apr. 4, 2022 (16 pages).

Yang et al., "Research Progress in Tobacco Fermentation" Journal of Biosciences and Medicines 2018, 6, 105-114.

Leffingwell, J.C., "Leaf Chemistry—Basic Chemical Constituents of Tobacco Leaf and Differences among Tobacco Types", Blackwell Science (Pub.), Jan. 1, 1999 (XP055499832, DOI: 10.13140/2.1.5173.6645).

Office Action issued in Europe for Application No. 21 724 666.9 dated Oct. 11, 2023 (35 pages).

Leffingwell, "Recent Advances in Tobacco Science vol. 2—Leaf Composition and Physical Properties in Relation to Smoking Quality and Aroma", The 30$^{th}$ Tobacco Chemists' Research Conference, 1976, Nashville, Tennessee.

Office Action issued in China for Application No. 202180032406.6 dated Oct. 21, 2024 (21 pages). English translation included.

Zhu Daheng et al., "Effect of Oxygen Condition on Chemical Components in Flue-cured Tobacco during Fermentation", Agriculture science of HeNan, 1999, No. 9 p. 12-14, Sep. 1999.

Office Action issued in Brazil for Application No. BR112022020519-8 dated Apr. 8, 2025 (4 pages). English translation included.

* cited by examiner

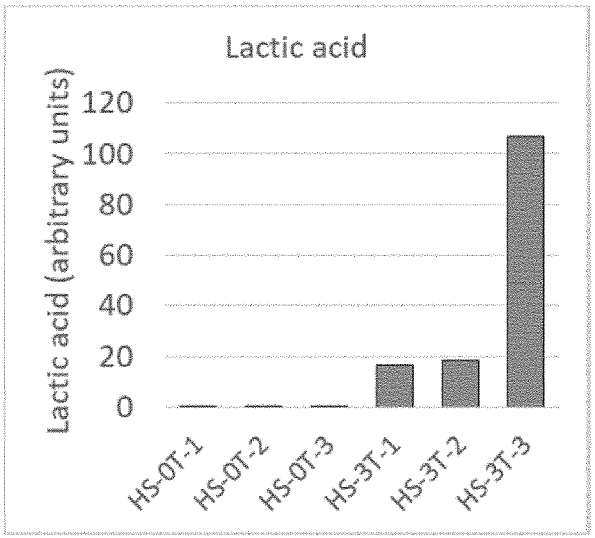
FIG. 1
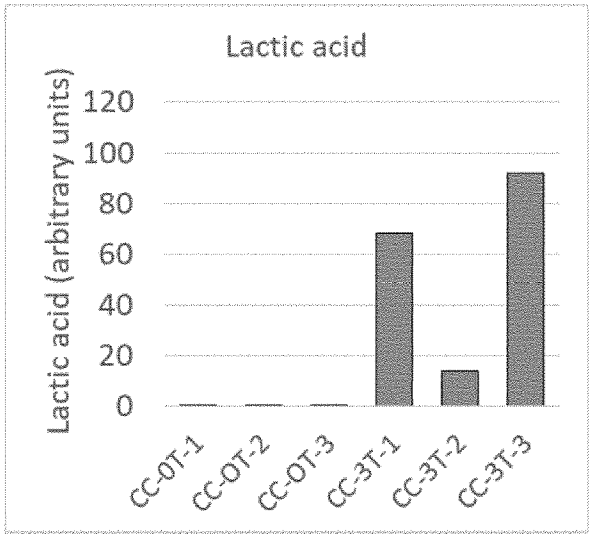
FIG. 2
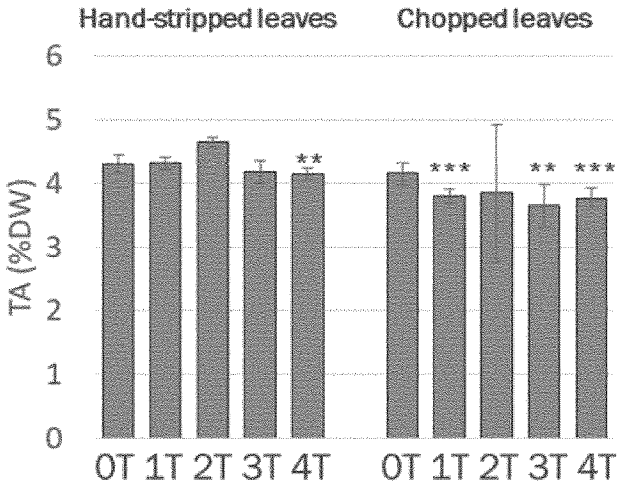
FIG. 3
FIG. 4

METHOD FOR TREATING TOBACCO MATERIAL AND TREATED TOBACCO MATERIAL

This application is a U.S. National Stage Application of International Application No. PCT/EP2021/062194 filed May 7, 2021, which was published in English on Nov. 11, 2021, as International Publication No. WO 2021/224474 A1. International Application No. PCT/EP2021/062194 claims priority to European Application No. 20173550.3 filed May 7, 2020.

The present invention relates to a method of treating tobacco and a treated tobacco by fermentation. In particular, the fermentation is an anaerobic fermentation.

Various treatment methods and additives have been proposed in the art for altering the overall character or nature of tobacco materials utilized in tobacco products. For example, tobacco materials have been treated with additives. In addition, treatment conditions used during the processing of those tobacco materials have been controlled, in order to alter the chemistry or sensory properties of tobacco products produced from such tobacco materials, and to alter the chemistry or sensory properties of mainstream smoke or aerosol generated by smoking articles incorporating such tobacco materials.

Treatments to enhance or add flavours and aromas to the tobacco material at a later stage of tobacco processing often involve the addition of one or more additive(s) to the tobacco and can require additional processing steps and equipment, which can be costly and time-consuming. Furthermore, the addition of additives to the tobacco may be not well perceived by some consumers.

There is therefore a need to modify the organoleptic properties of a tobacco material in a process which does not involve the addition of external flavourings to the tobacco itself. Furthermore, there is a need of a tobacco material which displays such different organoleptic material without requiring a complex processing.

According to an aspect, the invention relates to a method for treating tobacco material, the method comprising fermenting the tobacco material. Preferably, the fermenting step includes: incubating the tobacco material under anaerobic conditions. Preferably, the fermenting step includes: applying a pressure to the tobacco material comprised between 1000 kilograms per square meter and 4000 kilograms per square meter. Preferably, the fermenting step includes: keeping the moisture content of the tobacco material comprised between 25 percent in weight and 40 percent in weight of the total weight of the tobacco material. Preferably, the fermenting step lasts at least one month.

According to the method of the invention, a fermentation of the tobacco takes place under the claimed conditions. Due to the fermentation, certain chemical compounds present in the tobacco material may change and in turn organoleptic properties of the tobacco material may vary as well. Furthermore, the tobacco material fermented according to the method of the invention may present a lower level of asparagine.

It is known that tobacco material may ferment. Tobacco plants may host microorganisms which in turn may include bacteria, mould and *actinomyces*. Studies have shown that bacteria occupy most of the present microorganisms in the tobacco, while mould and *actinomyces* are minorities. Yeast is little or cannot be detected at all. Fermented tobacco can be made by various suitable techniques known in the art, for example as described in "*Research Progress in Tobacco Fermentation*" published by Yang Yang et al, Journal of Biosciences and Medicines 2018, 6, 105-114 available on line at: http://www.scirp.org/journal/jbm; or in U.S. Pat. No. 5,372,149, or in U.S. Pat. No. 4,528,993, and others. In general, tobacco fermentation includes adjusting the moisture content of cured, aged tobacco to a moisture content of from about 20 percent to about 60 percent, and allowing the moistened tobacco to ferment in piles. Fermentation can be terminated for example by drying or cold storage. Tobacco fermentation does not need the addition of microorganisms because, as mentioned above, microorganisms are generally naturally present in the tobacco plants.

Differently from what is known in the art, in the present invention the fermentation takes place under anaerobic condition.

Anaerobic fermentation is defined as the conversion of complex organic compounds into smaller molecules in the absence of oxygen. The term can be also defined as the conditions in which, as a result of both chemical equilibria and biochemical activities, oxygen is not available for redox reactions. Instead, other oxidized compounds may be present which can be used by micro-organisms for specific types of energy metabolism.

Anaerobic conditions may coexist with aerobic ones: oxygen in gaseous form may be unavailable to microorganisms in micro-environments (such as aggregates of detritus suspended in water) while at the same time it may be present in the macro-environment (water).

In tobacco anaerobic fermentation, without being bound by theory, the main energy extraction pathway may be coming from glycolysis, some amino acids being also used as carbon/nitrogen sources. The preferred nitrogenous compounds usually include glutamine, alanine, serine, threonine, aspartate, asparagine, urea, and arginine.

Preferably, the anaerobic conditions are achieved by: placing the tobacco material in a container and closing the container. Preferably, the anaerobic condition are achieved placing the tobacco material in a container, removing air from the container and closing the container in an air tight fashion.

More preferably, in order to remove the air from the tobacco material, pressure is applied. The applied pressure "squeezes out" the air from the tobacco material, so that, after the container is closed, oxygen is not present anymore, or it is present only in minimal quantity, in the container.

Placing the tobacco material in a container and closing the container, after the air has been removed from the closed container, allow reaching quickly the anaerobic conditions. This way of achieving anaerobic condition is preferable as it is cost effective and easy to implement.

Alternatively, the tobacco material is placed in a container and air is removed and replaced with water.

The container in which the tobacco material is placed is for example a barrel. Preferably, the barrel is made of wood, or concrete, or metal or a combination of any of these three materials.

The anaerobic conditions are kept for the desired fermenting duration.

In order to obtain the desired fermentation according to the invention, preferably the tobacco material has a moisture content comprised between 25 percent in weight and 40 percent in weight of the total weight of the tobacco material (weight by weight percentage). More preferably, the tobacco material has a moisture content comprised between 25 percent in weight and 35 percent in weight of the total weight of the tobacco material (weight by weight percentage). More preferably, the tobacco material has a moisture content comprised between 28 percent in weight and 32 percent in weight of the total weight of the tobacco material (weight by weight percentage). More preferably, the tobacco material has a moisture content of 30 percent in weight of the total weight of the tobacco material (weight by weight percentage). Preferably, in order to reach this moisture content, the tobacco material is wetted with water. Water is added to the tobacco material. Preferably, the tobacco material is wetted before being introduced in the container where the anaerobic conditions are obtained and kept.

Furthermore, during the fermentation step, this moisture content is maintained. Therefore, preferably, during the fermentation, the moisture content of the tobacco material is monitored. For example, if the tobacco material is introduced in a container where the fermentation takes place, the container may be opened, and the moisture of the tobacco material may be measured when the container is opened. Preferably, the container is opened at regular intervals in order to perform the measurement of the tobacco moisture.

The moisture may be measured by a moisture sensor provided inside the container. In this way, the moisture may be measured also when the tobacco material is in the closed container.

Preferably, moisture of the tobacco material is measured at regular intervals.

During the fermentation, the tobacco material is subject to a pressure. The pressure the tobacco material is subjected to is preferably comprised between 1000 kilograms per square meter ($kg/m^2$) and 4000 kilograms per square meter ($kg/m^2$).

The pressure applied to the tobacco material is maintained in the above range during fermentation.

The pressure may be applied to the tobacco material by any means. The pressure may be applied pumping an inert gas in the container. The pressure may be applied putting a weight on the tobacco material causing the desired pressure range to be applied to the tobacco material. For example, the container may be filled with wet tobacco material and, as a "lid" of the container, a weight is placed in contact to the tobacco material till water seeps out of the container.

Preferably, the tobacco material is inserted in a container and a weight is located on top or above the tobacco material to exert the desired pressure. Preferably, then the container is closed, leaving the weight inside the container, so that the weight may keep applying pressure to the tobacco material.

In the following, with the term "fermentation conditions", all these three conditions are meant: the anaerobic conditions, an amount of moisture in the tobacco material comprised between 25 percent in weight and 40 percent in weight of the total weight of the tobacco material, and an applied pressure comprised between 1000 kilograms per square meter and 4000 kilograms per square meter. Therefore, stating that the tobacco material is subject to the fermentation conditions, means that the tobacco material is subjected to anaerobic conditions, an amount of moisture in the tobacco material comprised between 25 percent in weight and 40 percent in weight of the total weight of the tobacco material, and an applied pressure comprised between 1000 kilograms per square meter and 4000 kilograms per square meter.

The tobacco material is subjected to the fermentation conditions above described for at least one month. Preferably, tobacco material is subjected to the fermentation conditions for at least two months. Preferably, tobacco material is subjected to the fermentation conditions for at least six months. Preferably, tobacco material is subjected to the fermentation conditions for at least 12 months. Preferably, tobacco material is subjected to the fermentation conditions for at least 24 months. Preferably, tobacco material is subjected to the fermentation conditions for less than 36 months.

The application of the fermentation conditions may be continuous for all the claimed time (for example, longer than one month, or longer than two months, or longer than 6 months, or longer than 12 months, or longer than 24 months). Alternatively, the fermentation conditions may be applied during a plurality of time intervals forming a sequence of time intervals. The time intervals are separated one from the other by "interruptions". For example, one or more interruptions of one or more of: presence of anaerobic conditions, amount of moisture comprised between 25 percent in weight and 40 percent in weight of the total weight of the tobacco material, application of a pressure comprised between 1000 kilograms per square meter and 4000 kilograms per square meter, may take place. The interruption may take place in order check the tobacco material. For example, the moisture of the tobacco material may be measured during an interruption. The interruption may take place to turn or mix the tobacco material, so that a uniform treated tobacco material may be obtained.

The interruption may last up to 6 hours.

The total period during which the tobacco is subjected to the above fermentation conditions is thus to be calculated adding the duration of all the time intervals during which the fermentation conditions are indeed applied. Alternatively, the total period can be calculated starting from the moment in which the fermentation conditions are applied for the first time and terminating when the fermentation conditions are applied for the last time, and then "removing" the duration of the interruptions.

For example, if a fermentation time T is selected, where with "fermentation time" the total period during which the tobacco material is subjected to the fermentation conditions is meant, the following cases are possible.

The fermentation conditions are applied continuously for a total duration equal to T.

The fermentation conditions are applied for N fermentation time intervals $t_1, t_2, \ldots, t_N$, where $t_1+t_2+\ldots+t_N=T$. The time gap between a fermentation time interval $t_j$ and the subsequent time interval $t_{j+1}$ is the interruption.

This total period T is of at least one month, or of at least two months, or of at least 6 months, or of at least 12 months, or of at least 24 months).

Preferably, between two consecutive time intervals in which the fermentation conditions are applied, an interruption is present. The interruption does not last longer than 6 hours.

The fermentation conditions are applied to the tobacco material for at least a month to see a desired chemical modification of the tobacco material. For example, the fermentation condition may be applied till the desired quantity of one or more chemical substances is reached in the tobacco material. For example, a chemical substance comprised in the tobacco material may lower or increase due to the fermentation conditions. The fermentation conditions are therefore stopped when the chemical substance reaches the desired quantity. For example, the fermentation condition can be applied till the desired colour of the tobacco material is obtained.

When the tobacco material is under the fermentation conditions, anaerobic fermentation takes place.

The temperature of the tobacco material during the fermentation (while fermentation conditions are applied) may remain comprised in a range of between 25 degrees Celsius and 35 degrees Celsius, more preferably between 27 degrees Celsius and 31 degrees Celsius. The temperature of the tobacco material is substantially maintained within this range during the whole fermentation (while fermentation conditions are applied). The temperature is maintained by the fermentation itself, there is no need of providing or subtracting heat to the tobacco material. This temperature of the tobacco material during fermentation is obtained when the ambient temperature of the ambient where the tobacco material is located is preferably comprised between 15 degrees Celsius and 25 degrees Celsius.

During fermentation under the fermentation conditions, the amount of reducing sugars and free amino acids present in the tobacco material has been monitored. Most abundant naturally present sugars in tobacco leaves are glucose, fructose and sucrose. Differences in sugar content may be present among tobacco varieties. For example, Virginia has high level of sugar (generally in a range from 8 percent to 30 percent) while Burley is characterized with low content of sugars (generally in a range of 1 percent to 2 percent). However, regardless of the tobacco type which is used in the tobacco material, a reduction in the content of reducing sugars during the fermentation under the fermentation conditions of the invention has been found.

Changes in the amount of reducing sugars may change the organoleptic properties of the tobacco material and of the smoke or aerosol produced with it.

Furthermore, tobacco material contains levels of amino acids. The amino acids may contribute substantially to the level of certain components in the smoke or aerosol produced by the final product where the fermented tobacco material is contained, and to the sensory properties of the smoke or aerosol. Different type of tobaccos may contain different quantities of amino acids. Furthermore, there can be a difference in amino acid profile between tobacco leaf or tips or stalk, mainly of quantitative nature. Also, the growing location for the tobacco may alter the ratios of the levels of different amino acids, but rather similar profiles for the same tobacco amino acid are generally maintained. Regardless of the tobacco type and origin, during fermentation under the fermentation conditions of the invention, it has been observed that the asparagine content in the tobacco material decreases.

This suggests that fermenting bacteria in the fermentation of the invention produce specific asparaginase(s) to assimilate C and N from amino acid resources.

Asparagine may be converted thermally into acrylamide. Acrylamide is considered a potentially harmful substance. It is desired to obtain a decrease in the content of asparagine in the tobacco material because it may concur in a decrease in the acrylamide formation.

The above changes in the amount of asparagine and in the reducing sugars in the tobacco material may be seen after one month from the moment in which the fermentation conditions are applied to the tobacco material. The fermentation conditions are applied and remain applied to the tobacco material for at least one month.

In the method of the invention, anaerobic fermentation of the tobacco material takes place when the tobacco material is subjected to the fermentation conditions. This anaerobic fermentation alters the reducing sugars and the asparagine amount in the tobacco material. Therefore, with a natural process such as fermentation and without the addition of additives or external microorganisms to the tobacco material, a reduction of certain potentially harmful substances may be achieved. These substances may include acrylamide. The fermentation in addition may change the organoleptic properties of the tobacco material. These organoleptic changes may take place because reducing sugars are converted to pyruvate and pyruvic acid, which are precursors of many other flavour compounds. This means that there may be a significant change in the organoleptic properties of the tobacco material after the fermentation of the invention. The taste characteristics of the tobacco material may be changed compared to those of the same tobacco material following conventional curing and without the application of the fermentation under fermentation conditions according to the invention.

As used herein, the terms "change" or "changed" are used in the context of the flavour or organoleptic properties to mean that there is a modification from one overall taste or sensory character to another, as identified by expert smokers. This may include an improvement.

Preferably, the method includes drying the tobacco material to obtain a dried tobacco material having a moisture content comprised between 1 percent and 15 percent in weight of the total weight of the tobacco material. The drying step is preferably performed after the fermentation under fermentation conditions has been terminated. After the total fermentation period T has elapsed, the treated tobacco material is preferably removed from the container where it was placed, and the pressure applied to the tobacco is decreased. The treated tobacco material is then dried to a water content of between 1 percent and 15 percent in weight of the total weight of the tobacco material, more preferably between 5 percent and 10 percent. The drying is performed so that the treated tobacco material may be easily processed is subsequent steps.

Preferably, the method comprises the step of: curing the tobacco material before fermenting. The tobacco material processed according to the method of the invention may comprise post-curing tobacco. As used herein, the term "post-curing tobacco" refers to tobacco that has been cured. The curing of the tobacco is preferably realized according to standard procedures and may depend on the type of tobacco which is included in the tobacco material. The tobacco material may include tobacco of different types and having had different curing. The tobacco of different types may be blended and then treated according to the invention.

Alternatively, or in addition, the tobacco material treated according to the method of the invention may comprise tobacco that has been re-graded, green-leaf blended, conditioned, de-stemmed or threshed (or not in the case of whole leaf), dried or packed.

Preferably, the method includes keeping the temperature of the tobacco material comprised between 25 degrees Celsius and 35 degrees Celsius. The temperature of the tobacco material is kept between 25 degrees Celsius and 35 degrees Celsius while the tobacco material is subjected to the fermentation conditions. The temperature of the tobacco material is automatically kept within this range by the fermentation process. No additional devices are needed to cool or heat the tobacco material.

Preferably, the method comprises the step of turning the tobacco material. The turning of the tobacco material may provide an improved homogenization. Turning the tobacco material may means turning the tobacco material upside down. Turning the tobacco material may means overturning the tobacco material. The interruption of the fermentation conditions caused by the turning may be used also to measure certain parameters of the tobacco material, for example the moisture content. During the turning of the tobacco material, the fermentation conditions may be not applied any more. All the three fermentation conditions may not be applied during the turning, or only some of them. The fermentation process is thus "interrupted". After turning, preferably the fermentation conditions are re-applied to the tobacco material.

Preferably, the method comprises: securing the tobacco material within a moisture retaining material. This step of securing the tobacco material preferably takes place before the tobacco material is subjected to the fermentation conditions. It is desirable for the moisture-retaining material to be resistant to degradation during the tobacco treatment process (the fermentation). The moisture-retaining material may comprise a flexible material. This flexible material may be wrapped around the tobacco material. The moisture retaining material preferably comprises plastic material. Alternatively, or in addition, the moisture-retaining material may comprise a rigid material. The container in which the tobacco material is introduced may function as a moisture retaining material. In this case, the material of the container may include for example metal, wood, plastic, or concrete.

Preferably, the method comprises: wetting the tobacco material in water before fermenting, so that a moisture content of the tobacco material comprised between 25 percent in weight and 40 percent in weight of the total weight of the tobacco material is achieved. After curing, the moisture of the tobacco material is generally low. Therefore, preferably water is added to the tobacco material to reach a moisture level between 25 percent and 35 percent in weight. More preferably, water is added also during the fermentation process in order to keep the moisture of the tobacco material comprised between 25 percent in weight and 40 percent in weight of the total weight of the tobacco material for at least one month, more preferably for at least 2 months, preferably for at least 6 months, preferably for at least 12 months, preferably for at least 24 months.

According to another aspect, the invention relates to a tobacco material treated according to the method of the previous aspect, wherein the treated tobacco material comprises an amount of asparagine at least 50 percent, more preferably 60 percent, even more preferably 80 percent lower than the amount of asparagine contained in the same tobacco material before the treatment according to the previous aspect. Preferably, at the end of the fermentation, the amount of asparagine is at least 50 percent, more preferably 60 percent, even more preferably 80 percent lower than the amount of asparagine contained in the same tobacco material before the treatment. The treated tobacco according to the method of the invention may change its chemical composition with respect to the untreated tobacco. "Treated tobacco material" in the present context means tobacco material that underwent the treatment as described in the previous process, that is, tobacco material that has been subjected for at least one month to the fermentation conditions. "Untreated tobacco material" in the present context means tobacco material that did not undergo the treatment as described in the previous process, that is, tobacco material that has not been subjected to the fermentation conditions. Untreated tobacco material is for example the tobacco material which is inserted in the container before the treatment of the invention starts. The treated tobacco material is compared with the same tobacco material which did not undergo the treatment according to the invention (the untreated tobacco material). The decrease in asparagine may be associated with an increase in aspartate. This suggests that fermenting bacteria produce specific asparaginase(s) to assimilate C and N from amino acid resources. This reaction may produce ammonia.

Preferably, the treated tobacco material comprises an amount of glutamine at least 50 percent, more preferably 60 percent, even more preferably 80 percent lower than the amount of glutamine contained in the same tobacco material before the treatment according to the method of the previous aspect. Preferably, at the end of the fermentation, the amount of glutamine is at least 50 percent, more preferably 60 percent, even more preferably 80 percent lower than the amount of glutamine contained in the same tobacco material before the treatment. The treated tobacco material according to the method of the invention may change its chemical composition with respect to the untreated tobacco material. The treated tobacco material is compared with the same tobacco material which did not undergo the treatment according to the invention. The decrease in glutamine may be associated with an increase in glutamate. This suggests that fermenting bacteria produce specific glutaminase(s) to assimilate C and N from amino acid resources. This reaction may produce ammonia.

Preferably, the treated tobacco material comprises an amount of total reducing sugars at least 50 percent, more preferably 60 percent, even more preferably 85 percent lower than the amount of total reducing sugars contained in the same tobacco material before the treatment according to the method of the previous aspect. Preferably, at the end of the fermentation, the amount of reducing sugars is at least 50 percent, more preferably 60 percent, even more preferably 85 percent lower than the amount of reducing sugars contained in the same tobacco material before the treatment. Reducing sugars are the sum of the following: glucose, fructose, sucrose, maltose. The majority of the reducing sugars in the treated tobacco material may be converted. Reducing sugar resources such as glucose and fructose present in the starting tobacco material may be used as a source of energy by the anaerobic bacteria. In the absence of oxygen, the glycolysis pathway transforms glucose (or fructose) into pyruvate. The altered levels of these compounds may contribute to the desirable taste and aroma of the treated tobacco material.

Preferably, the treated tobacco material is at least 100 times more acidic than the untreated tobacco material. The pH of the treated tobacco material and the pH of the untreated tobacco material may differ of at least 2 pH units. In different tobacco material, the pH may remain substantially unchanged.

Preferably, the treated tobacco comprises lactic acid. In anaerobic fermentation, lactic acid is known to be a related catabolic product. The lactic acid may have a "smoothing effect" regarding nicotine harshness. The lactic acid may be responsible in the lowering of the pH of the treated tobacco material.

According to another aspect, the invention relates to a tobacco material comprising: less than 3 percent of total reducing sugars in total dry weight basis. More preferably, the tobacco material comprises less than 2 percent of total reducing sugars in total dry weight basis. Even more preferably, the tobacco material comprises less than 1 percent of total reducing sugars in total dry weight basis. Preferably, the tobacco material comprises less than 300 milligrams per kilogram of asparagine in total dry weight basis. The tobacco material is fermented tobacco material. The tobacco material is preferably the tobacco material treated according to the method of the invention.

Advantages of the tobacco material of the invention have been already outlined with reference to the previous aspects and not repeated herewith.

The fermentation is obtained without the addition of any microorganisms besides those already included in the tobacco material before fermentation.

Preferably, the tobacco material comprises less than 70 milligrams per kilogram of glutamine in total dry weight basis.

Preferably, the tobacco material comprises more than 10000 milligrams per kilogram in total dry weight basis of total free amino acids.

Preferably, the tobacco material includes hand-stripped leaves from which ribs have been removed.

Preferably, the tobacco material is cured. Preferably, the curing is performed before fermentation.

Preferably, the tobacco material comprises Kasturi tobacco.

According to a different aspect, the invention relates to an aerosol generating article comprising a tobacco material according to the previous aspect.

The term "tobacco material" refers to any part of a tobacco plant or a mixture of different tobacco plants and includes without limitation tobacco leaf scraps, tobacco green leaf scraps, tobacco stems, tobacco dust created during tobacco processing, and tobacco leaf prime lamina strip and a combination thereof. The tobacco material can have the form of processed tobacco parts or pieces, cured and aged tobacco in essentially natural lamina or stem form, a tobacco extract or a mixture of the foregoing, for example, a mixture that combines extracted tobacco pulp with granulated cured and aged natural tobacco lamina. The tobacco material can be in solid form, in liquid form, in semi-solid form, or the like. Preferably, the term "tobacco material" includes any part and any related by-product, such as for example the leaves or stems, of any member of the genus *Nicotiana*. The tobacco material for use in the present invention is preferably from the species *Nicotiana tabacum*. Any type, style or variety of tobacco may be treated. Examples of tobacco which may be used include but are not limited to Virginia, Burley, and Oriental tobaccos, and blends of any of these types. Preferably, the tobacco material comprises Kasturi tobacco. The tobacco material to be treated may comprise or consist of post-curing tobacco.

As used herein, the term "post-curing tobacco" refers to tobacco that has been cured but has not undergone any further treatment process to alter the taste or aroma of the tobacco material. The post-curing tobacco may have been blended with other styles, varieties or types of tobacco. Alternatively, or in addition, the tobacco material to be treated may comprise or consist of tobacco that has been re-graded, green-leaf blended, conditioned, de-stemmed or threshed (or not in the case of whole leaf), dried or packed.

Preferably, the tobacco material comprises lamina tobacco material. The tobacco may comprise between about 70% and 100% lamina material.

When the tobacco material comprises lamina tobacco material, the lamina may be in whole leaf form. In some embodiments, the tobacco material comprises cured whole leaf tobacco. In some embodiments, the tobacco material substantially comprises cured whole leaf tobacco. In some embodiments, the tobacco material consists essentially of cured whole leaf tobacco.

In some embodiments, the tobacco material comprises stem tobacco material. The tobacco may comprise up to a 30 percent of stem material.

The process of "curing" green tobacco depends on the type of tobacco harvested. For example, Virginia flue (bright) tobacco is typically flue-cured, whereas Burley and certain dark strains are usually air-cured. The flue-curing of tobacco typically takes place over a period of five to seven days compared to one to two months for air-curing. Many major chemical and biochemical changes begin during the curing process and continue through the early phases of leaf drying. The conversion of the tobacco from its yellow to brown colour generally results in formation and substantial accumulation of nitrosamines, and an increased microbial content.

Different types of curing are used for different types of tobacco.

Virginia tobacco is generally 'flue-cured.' The tobacco leaves are hung in curing barns, where heated air is generated to dry the leaves. As the leaves lose moisture, they develop their distinct aroma, texture, and colour. The farmer must carefully guide this process, which takes up to a week, during which time the temperature of the heated air must be constantly monitored and gradually increased. Too much or too little heat at any stage of the process will have a negative impact on the quality of the tobacco.

Burley and oriental tobaccos are cured differently. Burley is 'air-cured' in barns where the heat and humidity come from natural ventilation. The curing process takes up to two months. Oriental tobacco is 'sun-cured' by hanging the leaves outdoors in the sun for about two weeks.

In the present text, the verbs "comprise" and "include" are synonyms and they both indicate a non-exhaustive list of features. The verb "consist" indicates an exhaustive list.

The invention is defined in the claims. However, below there is provided a non-exhaustive list of non-limiting examples. Any one or more of the features of these examples may be combined with any one or more features of another example, embodiment, or aspect described herein.

Example Ex1: A method for treating tobacco material, the method comprising:

- fermenting the tobacco material to obtain treated tobacco material, including:
  - incubating the tobacco material under anaerobic conditions;
  - applying a pressure to the tobacco material comprised between 1000 kilograms per square meter and 4000 kilograms per square meter;
  - keeping the moisture content of the tobacco material comprised between 25 percent in weight and 40 percent in weight of the total weight of the tobacco material;
- wherein the fermenting lasts at least one month.

Example Ex 2: The method according to Ex1, including the step of:

- drying the tobacco material to obtain a dried tobacco material having a moisture content comprised between 5 percent and 10 percent in weight of the total weight of the tobacco material.

Example Ex 3: The method according to Ex 1 or Ex 2, comprising the step of:

- curing the tobacco material before fermenting.

Example Ex 4: The method according to one or more of the preceding Ex 1-Ex 3, wherein the fermenting lasts less than three years.

Example Ex 5: The method according to one or more of the preceding Ex 1-Ex 4, comprising the step of

- turning the tobacco material.

Example Ex 6: The method according to one or more of the preceding Ex 1-Ex 5, including:

- adding water to the tobacco material to maintain the moisture content of the tobacco material comprised between 25 percent in weight and 40 percent in weight of the total weight of the tobacco material.

Example Ex 7: The method according to one or more of the preceding Ex 1-Ex 6, including keeping the temperature of the tobacco material comprised between 25 degrees Celsius and 35 degrees Celsius.

Example Ex 8: The method according to one or more of the preceding Ex 1-Ex 7, comprising:

securing the tobacco material within a moisture retaining material.

Example Ex 9: The method according to one or more of the preceding Ex 1-Ex 8, comprising:

wetting the tobacco material in water before fermenting, so that a moisture content of the tobacco material comprised between 25 percent in weight and 40 percent in weight of the total weight of the tobacco material is achieved.

Example Ex10: Method according to one or more of the preceding Ex 1-Ex 9, wherein the amount of asparagine in the treated tobacco material becomes at least 50 percent lower than the amount of asparagine contained in the same tobacco material before treatment according to Ex1-Ex9.

Example Ex11: Method according to one or more of the preceding Ex 1-Ex 10, wherein the amount of asparagine in the treated tobacco material becomes at least 50 percent lower than the amount of asparagine contained in the same tobacco material before treatment according to Ex1-Ex10.

Example Ex12: Method according to one or more of the preceding Ex 1-Ex 11, wherein the amount of reducing sugars in the treated tobacco material becomes at least 50 percent lower than the amount of reducing sugars contained in the same tobacco material before treatment according to Ex1-Ex11.

Example Ex 13: Tobacco material treated according to any one of Ex 1-Ex 12, wherein the treated tobacco material comprises an amount of asparagine at least 80 percent lower than the amount of asparagine contained in the same tobacco material before the treatment according to Ex 1-Ex 12.

Example Ex 14: Treated tobacco material according to Ex 13, wherein the treated tobacco material comprises an amount of glutamine at least 80 percent lower than the amount of glutamine contained in the same tobacco material before the treatment according to Ex 1-Ex 12.

Example Ex 15: Treated tobacco material according to Ex 13 or Ex 14, wherein the treated tobacco material comprises an amount of total reducing sugars at least 85 percent lower than the amount of total reducing sugars contained in the same tobacco material before the treatment according to Ex 1-Ex 12.

Example Ex 16: Treated tobacco according to any of the preceding Ex 13-Ex 15, wherein the treated tobacco material is at least 100 times more acidic than the same tobacco material before the treatment according to Ex 1-Ex 12.

Example Ex 17: Tobacco material comprising:

less than 3 percent of total reducing sugars in total dry weight basis;

less than 300 milligrams per kilogram of asparagine in total dry weight basis.

Example Ex 18: Tobacco material according to Ex17, comprising:

less than 1 percent of total reducing sugars in total dry weight basis.

Example Ex 19: Tobacco material according to Ex 17 or Ex 18, comprising:

less than 70 milligrams per kilo of glutamine in total dry weight basis.

Example Ex 20: Tobacco material according to one or more of Ex 17-Ex 19, wherein the fermented tobacco material comprises:

more than 10000 milligrams per kilogram in total dry weight basis of total free amino acids.

Example Ex 21: Tobacco according to any of the preceding Ex 17-Ex 20, comprising lactic acid.

Example Ex 22: Tobacco material according to one or more of Ex 17-Ex 21, wherein the tobacco material includes hand-stripped leaves from which ribs have been removed.

Example Ex 23: Tobacco material according to one or more of Ex 17-Ex 22, wherein the tobacco material is cured.

Examples Ex 24: Tobacco material according to one or more of Ex 17-Ex 24, including lactic acid.

Example Ex 25: Aerosol generating article comprising the tobacco material according to any one of Ex 17-Ex 24.

Examples will now be further described with reference to the figures in which:

FIG. 1 and FIG. 2 are histograms representing the quantity of lactic acid in the tobacco material of Example 1 and Example 2, respectively, measured before (0T) and after 6 months (3T) of fermentation according to the invention;

FIG. 3 and FIG. 4 are histograms representing the quantity of Total alkaloid (TA) levels (percent in total dry weight basis DW) in the tobacco material of Example 1 and Example 2, respectively, measured before (0T) and during fermentation according to the invention;

Figure 5:
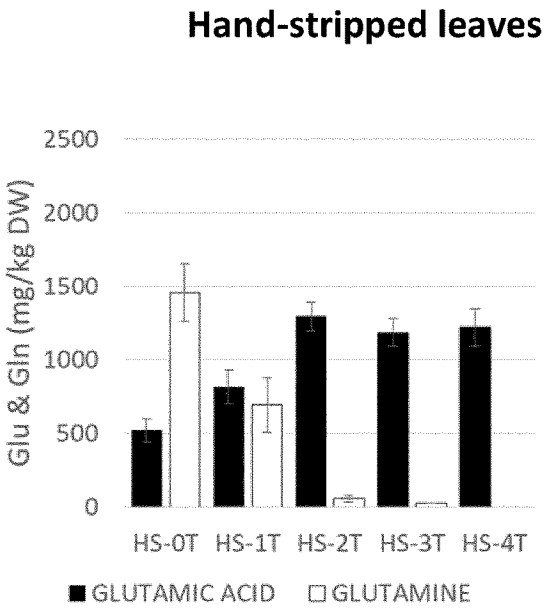
FIG. 5 and FIG. 6 are histograms representing the quantity of glutamine and glutamic acid in the tobacco material (in total dry weight basis, DW) of Example 1 and Example 2, respectively, measured before (0T) and during fermentation according to the invention.

A first and a second tobacco material of the same tobacco type but having a different processing before fermentation have been prepared. The tobacco material is Kasturi tobacco.

EXAMPLE 1

Dark tobacco leaf material has been fully sun-cured for about 10 days. The sun cured leaves have been stripped to keep only the lamina (hand stripped leaves). This tobacco material is referred to as "HS".

The tobacco material was conditioned to obtain a moisture of circa 30 percent. Samples of this tobacco material conditioned but not fermented yet are called 0T ("starting material").

The conditioned tobacco material is then introduced in three barrels, in each barrel circa 100 kilograms of tobacco material is present. Before the introduction, the tobacco material is wrapped in a material maintaining the acquired moisture.

Pressure is applied to each barrel. The pressure is comprised between 1000 kilograms per square meter and 4000 kilograms per square meter.

After 1 month (sample called 1T), 2.5 months (sample called 2T), 6 months (sample called 3T) and 8.5 months (sample called 4T), the barrels were opened, and the samples collected at least in triplicate in each barrel before tobacco turning and readjustment of the moisture content to approximatively 30 percent±5 percent.

During the heavy fermentation process under fully anaerobic conditions, the temperature inside the barrels did not particularly increase (it remained within the following temperature range: between 27 degrees Celsius and 31 degrees Celsius). The fermentation has been stopped after 8.5 months.

EXAMPLE 2

Dark tobacco leaf material has been yellowed for two days and rapidly chopped in cut-filler. This tobacco material contains both lamina and ribs. The chopped leaves containing both lamina and mid-ribs were sun-dried for two days. Samples of this tobacco material are named in the following "CC".

The tobacco material was conditioned to obtain a moisture content of circa 30 percent. Samples of this tobacco material conditioned but not fermented yet are called 0T ("starting material").

The conditioned tobacco material is then introduced in three barrels, in each barrel circa 100 kg of tobacco material is present. Before the introduction, the tobacco material is wrapped in a material maintaining the acquired moisture.

Pressure is applied to each barrel. The pressure is comprised between between 1000 kilograms over square meter and 4000 kilograms over square meter.

After 1 month (sample called 1T), 2.5 months (sample called 2T), 6 months (sample called 3T) and 8.5 months (sample called 4T), the barrels were opened, and the samples collected at least in triplicate in each barrel before tobacco turning and readjustment of the moisture content to approximatively 30 percent±5 percent.

During the heavy fermentation process under fully anaerobic conditions, the temperature inside the barrels did not particularly increase (it remained within the following temperature range: between 27 degrees Celsius and 31 degrees Celsius). The fermentation has been stopped after 8.5 months.

Visual Observations

The initial tobacco material was changing already after 2.5 month (samples 2T) of fermentation, the color of both HS and CC leaves became darker, the tobacco smell expressing nice caramel-buttery and fermented complex notes. The dark color was more marked in the fermented HS leaves compared to the CC leaves at the end of the process (8.5 month, 4T), likely due to the presence of leaf mid-rib in the CC leaves.

Chemical Analysis

In the following, when a value relative to a sample is mentioned, the given value represents an average of several values obtained for each sample of the same type.

The pH of the samples of tobacco material, both CC and HS, became acidic reaching 3.2, after fermentation conditions have been applied for 2.5 months (as found in sample 2T). This reflects the process of anaerobic fermentation involving sugars degradation, which usually produces organic acids like (acetic and/or) lactic acids. The starting pH of the tobacco material is generally comprised between 5 pH and 6 pH.

FIGS. 1 and 2 show the presence of lactic acid in the tobacco material. As shown by the figures (FIG. 1 represent lactic acid content in HS leaves and FIG. 2 in CC leaves), before fermentation, there is absence of lactic acid in all samples (three samples 0T per tobacco material—CC or HS—are shown). After fermentation (in this case after 6 months, three samples for tobacco material called 3T, shown for both tobacco materials—CC or HS), all samples, both CC and HS leaves, show the presence of lactic acid, albeit in variable amount.

Alkaloids were not or only slightly degraded during the fermentation. The total alkaloids (TA) content in percent in total dry weight basis (indicated as % DW in the figures) is shown in FIG. 3 (HS leaves) and FIG. 4 (CC leaves). The content of total alkaloids remained quite stable during the fermentation. After 8.5 month (4T), only 4 percent were degraded in HS and 9 percent in CC leaves. Although statistically relevant, such small variation may just result from sampling. Some limited alkaloid hydrolase activities may not be excluded. Total alkaloids were analyzed in samples collected during the heavy fermentation process at start (0T, n=6 samples have been analyzed), after 1(1T, n=9), 2.5 (2T, n=9), 6 (3T, n=9) and 8.5 (4T, n=12) months. T-tests (test statistics) were performed for comparison with the control, unfermented cured tobacco (0T). The results are shown in FIGS. 3 and 4 indicating the p-value, where the p-value is shown as follows:

*, $p<0.05$;

**, $p<0.01$ and

***, $p<0.001$.

Sample 4T of HS leaves and sample 3T of CC leaves have a p-value <0.01 and Samples 1T and 4T of CC leaves have a p-value <0.001. This indicates a statistical significant difference between the fermented tobacco material and the non-fermented one.

The nitrate content was not affected by the heavy fermentation process. However, some impact was observed on tobacco specific nitrosamines (TSNA): NNN (N'-nitrosonornicotine), NNK (nicotine-derived nitrosamine ketone) and NAT (N'-nitrosoanatabine). No changes were measured on NNK and NAT after 8.5 months fermentation. However, an increase of NNN was observed in both HS (3× increase) and CC (5-6× increase). As nornicotine, the precursor of NNN before nitrosation did not increase correspondingly, therefore NAT and NNK, but not NNN, may be partially degraded by bacteria during the fermentation run, since NNK and NAT first increased by a factor 2 till 2.5 months fermentation and then decreased to reach the initial value of non-fermented tobacco. This observation may mean that nitrosation of alkaloids occurs during heavy fermentation.

The evolution of sugars and free amino acids during the heavy fermentation according to the invention has been analyzed. The measurements performed in the samples of tobacco material are collected in Table 1. Table 1 shows the evolution of sugars and amino acids during the heavy fermentation process from the untreated tobacco material sample (samples 0T) to 8.5 months of fermentation process (samples 4T) under fermentation conditions in barrels containing either hand-stripped (HS) or Chopped (CC) leaves, as in Example 1 and Example 2. All values in the table are in total dry weight basis. The units of reducing sugars are in percent in total dry weight basis, while the free amino acids are in milligram per kilogram of total dry tobacco material. A drop of reducing sugars appeared after 2.5 month (2T, see Table 1) in phase with the color change and the slurry acidification. Glucose and fructose are two tobacco leaf substrates that anaerobic bacteria may metabolize in the fermentation barrels. Conversely, most of the amino acids increased during the process. Both asparagine and glutamine strongly decreased. Altogether, these observations may indicate that the main fermentation activities occurred between the first and the third month. Proline was not degraded under anaerobic fermentation (see Table 1). Ornithine strongly increased during fermentation (>100 times) in both HS and CC, as well as citrulline (data obtained from metabolomic analyses between 0T and 3T) increasing by a factor 16 in HS and 2 in CC. This may indicate that (plant-derived) lactic acid bacteria are active in the tobacco fermenting barrels, since such bacteria are described to produce ornithine and citrulline at high levels (Rakhimuzzaman et al., *Biol Pharm Bull.* 2019; 42(9):1581-1589).

abundant organic acids in plants. Citrate and malate, like reducing sugars, are also metabolized during the tobacco heavy fermentation: it is shown from chemical analysis of the samples that more than 60% of the glucose and fructose, citrate and malate present in the starting tobacco material (samples 0T), hand-stripped and chopped leaves are catabolized after 6 months of heavy fermentation (samples 3T).

TABLE 1

| | | HS-OT | HS-1T | HS-2T | HS-3T | HS-4T | CC-OT | CC-1T | CC-2T | CC-3T | CC-4T |
|---|---|---|---|---|---|---|---|---|---|---|---|
| Sugars (% DW) | GLUCOSE | 3.0 | 3.2 | 0.4 | 0.3 | 0.5 | 4.0 | 4.6 | 0.7 | 0.9 | 1.0 |
| | FRUCTOSE | 4.3 | 4.1 | 0.3 | 0.2 | 0.2 | 4.9 | 5.1 | 0.4 | 0.3 | 0.3 |
| | SUCROSE | 0.1 | 0.0 | 0.0 | 0.0 | 0.0 | 0.9 | 0.0 | 0.0 | 0.0 | 0.0 |
| | MALTOSE | 0.0 | 0.0 | 0.0 | 0.0 | 0.0 | 0.1 | 0.0 | 0.0 | 0.0 | 0.0 |
| | SUM OF SUGARS | 7.4 | 7.3 | 0.7 | 0.5 | 0.7 | 9.8 | 9.7 | 1.1 | 1.2 | 1.3 |
| Free Amino Acids (mg/kg DW) | ASPARTIC ACID | 252.0 | 951.3 | 2459.0 | 2702.3 | 2933.2 | 160.7 | 1492.0 | 1742.7 | 2184.7 | 2074.0 |
| | GLUTAMIC ACID | 518.7 | 813.3 | 1293.7 | 1185.0 | 1219.8 | 787.0 | 949.7 | 1201.7 | 986.0 | 1002.0 |
| | ALANINE | 601.3 | 762.3 | 1231.3 | 1374.7 | 1524.3 | 293.0 | 624.7 | 1084.0 | 1403.7 | 1652.2 |
| | ARGININE | 41.3 | 123.7 | 147.0 | 180.0 | 210.3 | 17.0 | 237.0 | 140.3 | 267.3 | 226.8 |
| | ASPARAGINE | 1604.3 | 1920.7 | 212.0 | 42.7 | 22.3 | 1747.0 | 640.0 | 287.7 | 124.3 | 139.0 |
| | PROLINE | 4165.3 | 5108.7 | 4885.0 | 4838.3 | 4920.8 | 2962.3 | 3502.0 | 3017.7 | 3415.3 | 3417.0 |
| | PHENYLALANINE | 234.0 | 400.7 | 336.0 | 402.0 | 414.5 | 236.3 | 386.7 | 243.0 | 312.7 | 327.8 |
| | GLYCINE | 68.0 | 111.0 | 251.7 | 342.3 | 376.3 | 48.0 | 155.7 | 254.0 | 344.0 | 363.8 |
| | GLUTAMINE | 1456.0 | 692.0 | 56.7 | 25.3 | 0.0 | 1921.0 | 314.3 | 57.7 | 17.0 | 52.5 |
| | ISOLEUCINE | 31.7 | 99.0 | 165.3 | 217.3 | 182.0 | 43.0 | 197.7 | 188.0 | 258.7 | 215.3 |
| | HYSTIDINE | 122.7 | 185.0 | 142.0 | 136.0 | 115.5 | 160.3 | 145.7 | 109.7 | 109.7 | 91.0 |
| | LEUCINE | 113.3 | 238.3 | 372.7 | 464.7 | 621.5 | 143.7 | 473.7 | 334.3 | 419.7 | 585.8 |
| | LYSINE | 54.0 | 131.7 | 183.0 | 241.0 | 256.2 | 40.0 | 242.3 | 240.0 | 232.0 | 340.5 |
| | METHIONINE | 30.0 | 34.0 | 16.7 | 11.0 | 20.3 | 16.0 | 38.7 | 12.0 | 11.0 | 28.8 |
| | ORNITHINE | 0.0 | 0.0 | 92.7 | 113.0 | 87.8 | 18.0 | 0.0 | 125.0 | 97.0 | 89.2 |
| | SERINE | 297.3 | 393.3 | 453.7 | 495.7 | 535.3 | 277.3 | 444.7 | 500.7 | 583.7 | 609.7 |
| | TYROSIN | 81.3 | 135.3 | 221.3 | 274.3 | 247.3 | 111.0 | 233.3 | 246.0 | 318.7 | 277.8 |
| | THREONINE | 156.7 | 272.0 | 346.7 | 433.3 | 449.5 | 184.0 | 350.0 | 392.7 | 470.3 | 473.3 |
| | VALINE | 279.0 | 398.3 | 468.0 | 523.3 | 496.0 | 278.3 | 593.0 | 627.3 | 784.0 | 626.5 |
| | GABA | 326.0 | 465.7 | 507.0 | 468.3 | 438.0 | 358.7 | 980.7 | 842.3 | 860.7 | 845.7 |
| | TOTAL FREE AMINO ACIDS | 10459.7 | 13270.7 | 13886.3 | 14494.0 | 15225.2 | 9813.0 | 12027.7 | 11658.7 | 13293.0 | 13520.2 |

Figure 6:
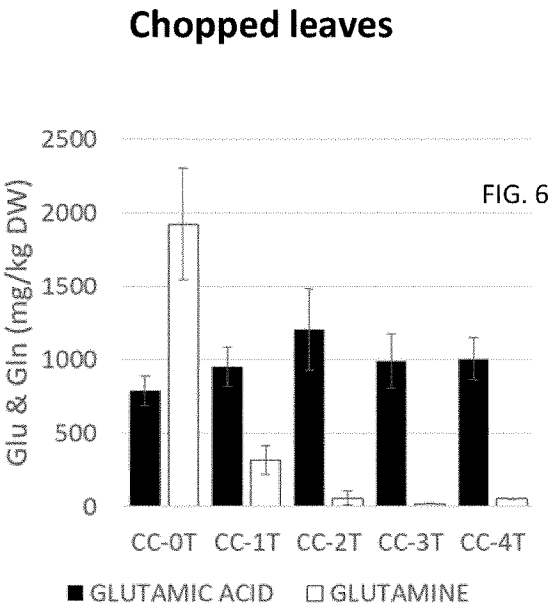
Figure 7:
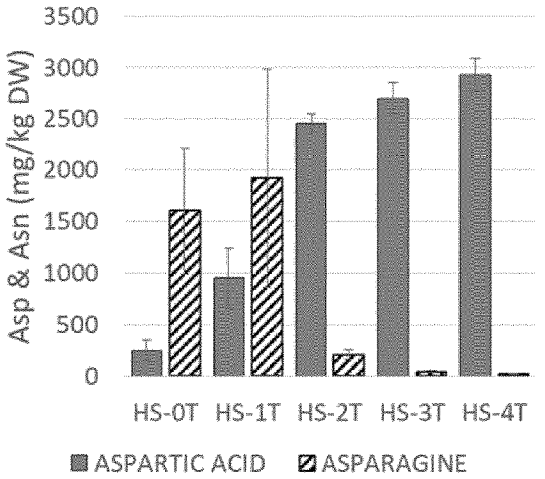
FIG. 7 and FIG. 8 are histograms representing the quantity of asparagine and aspartic acid in the tobacco material (in total dry weight basis, DW) of Example 1 and Example 2, respectively, measured before (0T) and during fermentation according to the invention.
Figure 8:
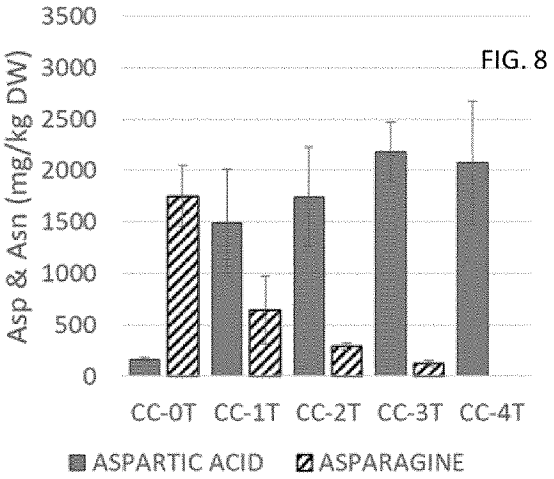

In FIGS. 5-8, the amount of glutamine and asparagine in the tobacco material is shown. As shown by FIGS. 5-8 and based on the data presented in Table 1, deamination of glutamine and asparagine occurring during the heavy fermentation process of both HS and CC leaves may be correlated with the concomitant increase of glutamate and aspartate, respectively. This suggests that fermenting bacteria produce specific glutaminase(s) and asparaginase(s) to assimilate C and N from amino acid resources. Both reactions produce ammonia that increased twofold during the anaerobic fermentation process of both HS and CC leaves. FIGS. 5 and 6 show the level of glutamine (white histograms) and glutamic acid (black histograms) in HS leaves and CC leaves, respectively. It is clear from the figures that during fermentation glutamine decreases and glutamic acid increases. FIGS. 7 and 8 show the level of asparagine (striped histograms) and aspartic acid (black histograms) in HS leaves and CC leaves, respectively. It is clear from the figures that during fermentation asparagine decreases and aspartic acid increases.

A metabolomic study was performed to identify marker molecules or pathways related to the tobacco leaf anaerobic fermentation process. Sugar resources such as glucose and fructose present in the starting material (control) of both HS and CC leaves may be used as a source of energy by the anaerobic bacteria (see Table 1). In the absence of oxygen, the glycolysis pathway transforms glucose (or fructose) into pyruvate producing 2 ATP and 2 NADH+H+. Other organic and rich carbon compounds that may be rapidly used by anaerobic bacteria are citrate and malate (Bintsis, T, 2018, *AIMS Microbiology,* 4(4): 665-684), both being the most Another observation that can be coupled to the consumption of such organic molecules is the increase of pyruvate (13-14 times) in both HS and CC fermented tobacco material. Pyruvate is the substrate of several reactions that may occur under anaerobic conditions: (1) the production of D-lactate, mostly to regenerate NAD+ for the glycolytic reaction; (2) the production of acetate, diacetyl and 2,3 butanediol that may contribute to the delivery of aromatic compounds and flavours in heavy fermented tobacco. Pyruvate may lead to the generation of aromatic compounds, like 2,3-butanediol or lactate as a product of lactic acid bacteria.

Two other pathways emerged from the metabolomic analyses of heavy fermented tobacco: (1) the degradation of tryptophan and (2) the catabolism of chlorogenic acid.

Regarding tryptophan degradation, the pathway has been described by Ummadi and Weimer (2001, J. Dairy Sci. 84:1773-1782) for cheese bacteria and adapted accordingly. In this case, more than 78% of the tryptophan present in the starting tobacco material (samples 0T) is catabolized after 6 months of fermentation (samples 3T) in both HS and CC leaves. The pathway indicated that the product resulting from such a catabolic reaction is principally indole-3-lactic acid. This is illustrated by an increase of 14 times and 28 times in HS and CC leaves, respectively. No other compound belonging to this pathway showed such an increase. No specific aromatic properties had been reported for this compound.

Chlorogenic acid (CGA), an important biologically active dietary polyphenol, is produced by certain plant species, like tobacco, and is a major component of coffee. In heavy fermented tobacco leaf, CGA is completely degraded after the anaerobic fermentation process. On the other side, products resulting from the catabolism of CGA, namely quinic and caffeic acids, increased in both HS and CC leaves after 6 months fermentation. This likely results from bacterial cinnamoyl esterase activities as documented by Guglielmetti et al. (2008, *Applied and Environmental Microbiology,* 74, 4: 1284-1288). Therefore, part of the quinic and caffeic acid pools likely result from the hydrolysis of CGA, whereas none of them was reported to have flavor properties.

The presence of elevated pyruvate, indole-3-lactic acid and the lack of chlorogenic acid in heavy fermented tobacco compared to cured tobacco can make them useful as chemical markers.

For the purpose of the present description and of the appended claims, except where otherwise indicated, all numbers expressing amounts, quantities, percentages, and so forth, are to be understood as being modified in all instances by the term "about". Also, all ranges include the maximum and minimum points disclosed and include any intermediate ranges therein, which may or may not be specifically enumerated herein. In this context, therefore, a number A is understood as A±10 percent of A. Within this context, a number A may be considered to include numerical values that are within general standard error for the measurement of the property that the number A represents. The number A, in some instances as used in the appended claims, may deviate by the percentages enumerated above provided that the amount by which A deviates does not materially affect the basic and novel characteristic(s) of the claimed invention. Also, all ranges include the maximum and minimum points disclosed and include any intermediate ranges therein, which may or may not be specifically enumerated herein.

A third tobacco material of a different tobacco type than in Example 1 and Example 2 has been prepared. The tobacco material is Virginia tobacco.

EXAMPLE 3

Tobacco leaf material has been fully sun-cured for about 10 days. The sun cured leaves have been treated as standard for Virginia tobacco.

The tobacco material was conditioned to obtain a moisture of circa 30 percent. Samples of this tobacco material conditioned but not fermented yet are called BF (starting material before fermentation).

The conditioned tobacco material is then introduced in two barrels, in each barrel circa 100 kilograms of tobacco material is present. Before the introduction, the tobacco material is wrapped in a material maintaining the acquired moisture.

Pressure is applied to each barrel. The pressure is comprised between 1000 kilograms per square meter and 4000 kilograms per square meter.

After 1 month (sample called 1T), 2 months (sample called 2T), 3 months (sample called 3T), 4 months (sampled called 4T), 5 months (sampled called 5T), 6 months (sample called 6T), 7 months (sample called 7T) and 8 months (sample called AF, after fermentation), the barrels were opened.

During each month, the tobacco material in the two barrels has been turned at least 6 times.

Samples have been collected before fermentation (VG-BF: starting material, 6 replicates), during the fermentation process (in all months from VG-T1 to VG-T7, 3 replicates per barrel) and after fermentation (VG-AF: after fermentation, 6 replicates).

During the sample collection, the tobacco material has been turned and the moisture content of the tobacco material has been readjusted to approximatively 30 percent±5 percent.

During the heavy fermentation process under fully anaerobic conditions, no major changes of temperature were observed during the fermentation process moving linearly from 30 degrees Celsius at the beginning of the fermentation (VG-T1) to 26 degrees Celsius at the end of the fermentation (VG-AF). The temperature has been measured inside the barrels using captors.

The pH of the tobacco material did not change significantly during the fermentation run (T1 to AF) staying at 5.1±0.3.

The fermentation has been stopped after 8 months.

Visual Observations

As seen for the Kasturi tobacco material, the color of the tobacco material at the end of the fermentation process (VG-AF) became remarkably darker compared to the starting material (VG-BF). However, after 4 month of anaerobic fermentation (VG-T4), the Virginia tobacco material did not show the same "darkness as the Kasturi tobacco after the same amount of fermentation, indicating possibly that 4 months are not sufficient to get full fermentation of Virginia tobacco material.

Chemical Analysis

In the following, when a value relative to a sample is mentioned, the given value represents an average of several values obtained for each sample of the same type.

The behavior of lactic acid over time in the tobacco material is very similar to what is depicted in FIGS. 1 and 2. Qualitatively, before fermentation, there is absence of lactic acid in all samples. After fermentation, lactic acid is present, albeit in variable amount.

Figure 9:
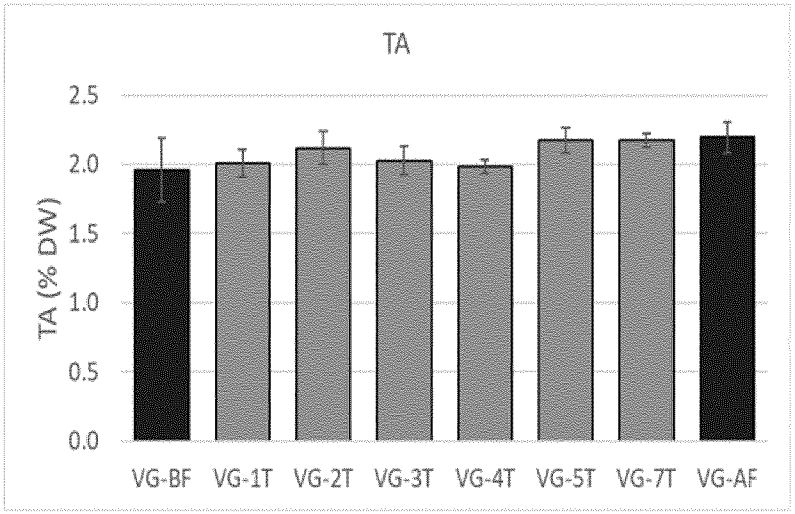
FIG. 9 and FIG. 10 are histograms representing the quantity of total alkaloids and reducing sugars in the tobacco material (in total dry weight basis, DW) of Example 3, respectively, measured before (VG-BF), during fermentation and after fermentation (VG-AF) according to the invention.

FIG. 9 shows the evolution of total alkaloids (TA) during the fermentation process. These data confirm that alkaloids and in particular nicotine (not shown) are not impacted by anaerobic fermentation. The bacteria did not consume major alkaloids as fermenting substrates.

Figure 10:
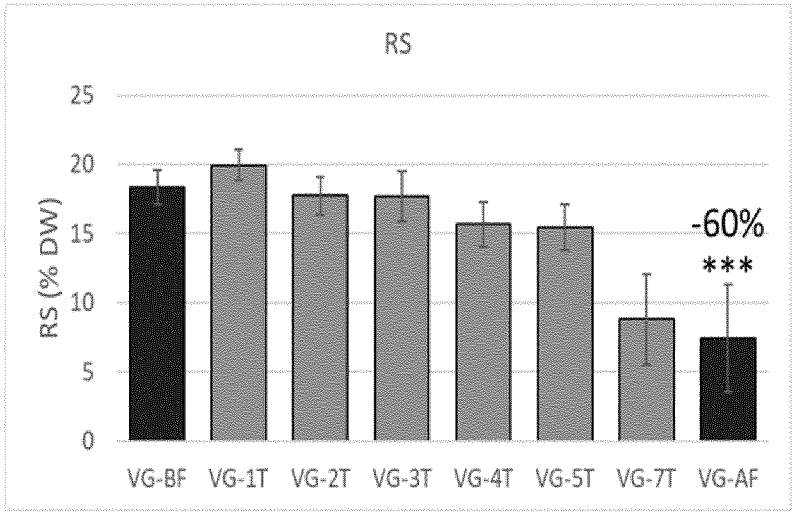

On the other hand, as depicted in FIG. 10, and as already observed in Example 1 and Example 2, reducing sugars were used as substrate by fermenting bacteria. Therefore about 60% of the reducing sugars (RS) were oxidized during the 8 month of fermentation, moving from 18.3 percent (VG-BF) to 7.4 (VG-AF) percent in dry weight (DW). It is possible that a longer period of fermentation would lead to a higher percentage of RS degradation.

The average (n=6) and SD are presented in FIGS. 9 and 10, as well as t-tests (paired) performed between BF and AF.

Further chemical analysis showed that the starting material (VG-BF) had a content of 262 micrograms per gram (μg/g) of asparagine on a dry weight basis. The same tobacco material after fermentation, (8 months, VG-AF) has a content of 19 micrograms per gram (μg/g) of asparagine on a dry weight basis.

The starting material (VG-BF) had a content of 185 micrograms per gram (μg/g) of glutamine on a dry weight basis. The same tobacco material after fermentation, (8 months, VG-AF) has a content of 12 micrograms per gram (μg/g) of glutamine on a dry weight basis.

The invention claimed is:

1. A method for treating tobacco material, the method comprising:

fermenting the tobacco material to obtain treated tobacco material, including:

incubating the tobacco material under anaerobic conditions;

applying a pressure to the tobacco material comprised between 1000 kilograms per square meter and 4000 kilograms per square meter;

keeping the moisture content of the tobacco material comprised between 25 percent in weight and 40 percent in weight of the total weight of the tobacco material;

wherein the fermenting lasts at least two months.

2. The method according to claim 1, including the step of:

drying the tobacco material to obtain a dried tobacco material having a moisture content comprised between 5 percent and 10 percent in weight of the total weight of the tobacco material.

3. The method according to claim 1, comprising the step of:

curing the tobacco material before fermenting.

4. The method according to claim 1, including keeping the temperature of the tobacco material comprised between 25 degrees Celsius and 35 degrees Celsius.

5. The method according to claim 1, comprising the step of turning the tobacco material.

6. The method according to claim 1, comprising:

securing the tobacco material within a moisture retaining material.

7. The method according to claim 1, comprising:

wetting the tobacco material in water before fermenting, so that a moisture content of the tobacco material comprised between 25 percent in weight and 40 percent in weight of the total weight of the tobacco material is achieved.

8. The method according to claim 1, wherein the amount of asparagine in the treated tobacco material becomes at least 50 percent lower than the amount of asparagine contained in the same tobacco material before treatment.

9. The method according to claim 1, wherein the amount of reducing sugars in the treated tobacco material becomes at least 50 percent lower than the amount of reducing sugars contained in the same tobacco material before treatment.

* * * * *